US010882164B2

(12) United States Patent
Perndl et al.

(10) Patent No.: US 10,882,164 B2
(45) Date of Patent: Jan. 5, 2021

(54) HAND TOOL WITH ADJUSTABLE FASTENING HEAD AND VARIABLE OUTPUT TORQUE

(71) Applicant: Rohde & Schwarz GmbH & Co. KG, Munich (DE)

(72) Inventors: Werner Perndl, Zorneding (DE); Markus Leipold, Isen (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 352 days.

(21) Appl. No.: 15/218,021

(22) Filed: Jul. 23, 2016

(65) Prior Publication Data

US 2017/0239793 A1 Aug. 24, 2017

Related U.S. Application Data

(60) Provisional application No. 62/299,531, filed on Feb. 24, 2016.

(51) Int. Cl.

| | |
|---|---|
| ***B25B 23/00*** | (2006.01) |
| ***B25B 23/14*** | (2006.01) |
| ***B25B 23/142*** | (2006.01) |
| ***B25B 17/02*** | (2006.01) |
| *B25G 1/06* | (2006.01) |
| *B25B 13/46* | (2006.01) |
| *B25B 17/00* | (2006.01) |

(Continued)

(52) U.S. Cl.

CPC ..... *B25B 23/0028* (2013.01); *B25B 17/02* (2013.01); *B25B 23/141* (2013.01); *B25B 23/1427* (2013.01); *B25B 13/00* (2013.01); *B25B 13/467* (2013.01); *B25B 15/005* (2013.01); *B25B 17/00* (2013.01); *B25G 1/063* (2013.01)

(58) Field of Classification Search

CPC ... B25B 23/0028; B25B 17/02; B25B 23/141; B25B 23/1427; B25B 13/481; B25B 13/467; B25B 13/00; B25B 15/005; B25B 17/00; B25G 1/063

USPC ..... 81/478, 57.3, 177.8, 480

See application file for complete search history.

(56) References Cited

U.S. PATENT DOCUMENTS 1,970,721 A 8/1934 Walton
2,826,107 A * 3/1958 Woods ..... B25B 13/465 192/46

(Continued)

FOREIGN PATENT DOCUMENTS

DE 20308402 U1 9/2003
DE 102005040573 B4 3/2007

(Continued)

*Primary Examiner* — Hadi Shakeri
*Assistant Examiner* — Katina N. Henson
(74) *Attorney, Agent, or Firm* — Potomac Technology Law, LLC

(57) ABSTRACT

A hand tool for fastening a fastener, such as a screw. The hand tool comprises a handle and a rotatable fastening head connected to a first end of the handle, and engaged with a manually driven actuator. The hand tool further comprises a fixed fastening head connected to a second end of the handle, which is configured to apply a configurable fastening torque to the fastener The fixed fastening head is selectively pivotable with respect to the handle about an axis parallel to the center axis of the fixed fastening head.

20 Claims, 4 Drawing Sheets

(51) Int. Cl.
*B25B 13/00* (2006.01)
*B25B 15/00* (2006.01)

(56) References Cited

U.S. PATENT DOCUMENTS

| | | | | |
|---|---|---|---|---|
| 3,906,820 | A | 9/1975 | Hauk | |
| 6,923,094 | B1 * | 8/2005 | Marquardt | B23Q 5/045 81/177.8 |
| 7,272,998 | B1 * | 9/2007 | Gauthier | B25B 23/141 81/473 |
| 7,478,577 | B1 | 1/2009 | Wheeler | |
| 2006/0156871 | A1 * | 7/2006 | Wu | B25B 13/481 81/177.7 |
| 2008/0229866 | A1 | 9/2008 | Rowell | |
| 2011/0120272 | A1 | 5/2011 | Peng et al. | |
| 2011/0179912 | A1 | 7/2011 | Lin | |
| 2012/0011971 | A1 * | 1/2012 | Ogata | B25B 23/1427 81/478 |
| 2012/0132041 | A1 | 5/2012 | Bills | |

FOREIGN PATENT DOCUMENTS

| | | | |
|---|---|---|---|
| DE | 102005046649 | B4 | 4/2007 |
| DE | 102008021411 | A1 | 4/2009 |
| DE | 102014213321 | A1 | 12/2015 |
| EP | 1688221 | A1 | 8/2006 |
| GB | 2453008 | A | 3/2009 |
| JP | 3027710 | | 5/1996 |

* cited by examiner

HAND TOOL WITH ADJUSTABLE FASTENING HEAD AND VARIABLE OUTPUT TORQUE

RELATED APPLICATIONS

This application claims the benefit of the earlier filing date under 35 U.S.C. § 119(e) of U.S. Provisional Application Ser. No. 62/299,531 (filed 2016 Feb. 24).

FIELD

The invention relates to a hand tool for fastening screw connections. The invention particularly relates to a hand tool with enhanced fastening means comprising a rotatable fastening head and a fixed fastening head configured for applying a preset fastening torque onto a screw.

BACKGROUND

Hand tools for loosening or tightening screw connections are well known in the prior art. The most common hand tools are screw drivers or wrenches that are either manually operable or motor-driven. The screw drivers or wrenches may be designed for being used with different profiles of a screw head such as slotted or cross recessed, inner or outer hexagon head, Torx or the like. It is noted that the terms screw driver and screw wrench will be used as synonyms throughout the present description.

Also known are hand tools designed for application in restricted spatial conditions. Such specifically adapted hand tools encompass for example spanners with angled spanner jaws, ratchet wrenches, L-keys or offset screwdrivers. An example for the latter is a hexagonal offset screwdriver having a fastening profile with ground lateral edges and with a ball end, which allows the tool to be used at an angle off-axis to the screw. The maximum fastening angle for these type of screwdriver is about 20°.

An example of restricted spatial conditions is the assembly of waveguides for application in the microwave and/or millimeter wave range. Such waveguides usually have to be of relatively short length whereby the waveguide housing comprises flanges which are to be connected by screw connections. With common hand tools, the assembly of such couplings is rather cumbersome in particular due to the desired short length of the waveguides. Thereby, the accessibility of the screw connection to be fastened by the hand tool becomes more difficult the shorter the length of the waveguide. The assembly process of waveguides may thus result in a combination of different measures such as manually driving in screws with the bare fingers, attempts to fasten the screw with hexagonal offset screwdrivers and/or the use of specifically designed angled Allen keys with very short head portion, which however results in a multitude of required turns, disengagement and engagement steps of the key.

Due to these restrictions of the assembly process, waveguide connections nowadays are constructed in such a way to enable a facilitated assembly with the available hand tools. This, however, leads to the construction of waveguides having a length that may be larger than the optimal length under a pure high frequency characteristics perspective.

DE 10 2014 213 321 A1 relates to an angle wrench with a fastening head for fastening a screw, the fastening head being rotatably mounted in the angle wrench. An actuator for manual operation is also rotatably supported in the angle wrench and engages the rotatable fastening head such that manual actuation of the actuator puts the fastening head in rotation.

US 2011/0120272 A1 relates to a ratchet wrench with variable output torque that comprises a wrench body with a shank having an end forming a driving section for coupling with a socket and an opposite end pivotally connected to an end of a control bar through a pivot pin. The pivot pin is arranged substantially perpendicular to a central axis of the driving section so that the control bar is rotatable about the pivot pin for angular displacement with respect to the shank.

What is needed, therefore, is an enhanced hand tool that facilitates improved fastening of screw connections under restricted spatial conditions.

SUMMARY

Embodiments of the present invention advantageously address the foregoing requirements and needs, as well as others, by providing embodiments of a hand tool that facilitates improved fastening of screw connections under restricted spatial conditions.

In accordance with example embodiments, a hand tool for fastening a screw comprises a handle and a rotatable fastening head connected to a first end portion of the handle and which is engaged with a manually driven actuator. The hand tool further comprises a fixed fastening head configured for applying a preset fastening torque onto a screw and connected to a second end portion of the handle, wherein the fixed fastening head is selectively pivotable with respect to the handle about an axis parallel to a center axis of the fixed fastening head. By way of example, such a hand tool may comprise an angle screw wrench or angle screw driver, such as a hexagon wrench (Allen key) with a ball end.

According to further embodiments, the hand tool comprises a handle with at least a first and second end portion. Further, the handle may be designed for being gripped and held by a human hand. The handle may be formed by a handle portion, a shaft or a main or base body portion of the hand tool. An axis that extends in parallel to a longitudinal extension of the handle or the shaft is referred to herein as a main axis of the hand tool. By way of example, the first and second end portions of the handle are arranged on opposing sides of the handle with respect to the main axis. As would be recognized by one of skill in the art, other configurations of the first and second end portions are also possible, whereby accessibility to screw connections in restricted spatial conditions is enabled.

According to further embodiments, the rotatable fastening head and the fixed fastening head are generally designed for engaging fastening elements such as in particular screw connections (e.g., screws and nuts). The rotatable fastening head and the fixed fastening head are thereby designed to fasten or loosen a screw connection. By way of example, the rotatable fastening head and the fixed fastening head may be designed for driving various screw drive types such as slotted or cross recessed, hex or hex socket, Torx, square, double-square or triple-square. By way of further example, the rotatable fastening head and/or the fixed fastening head comprise a multi-edge profile such as hexagonal cross-sectioned profile with a ball end.

According to further embodiments, the rotatable fastening head and the manually driven actuator of the hand tool may be configured as described in the document DE 10 2014 213 321 A1, which is attached hereto as Annex A.

According to further embodiments, the rotatable fastening head is freely rotatable about a fixed axis with respect to the hand tool. The rotational axis may be oriented perpendicular to the main axis of the hand tool. Alternatively, the rotational axis may be arranged angled with respect to the main axis of the hand tool. Thereby, the first end portion of the handle to which the rotatable fastening head is connected may be formed by a beam that is arranged at a fixed angle with respect to a main portion of the handle.

According to further embodiments, the hand tool comprises a head rotating element, which transfers a rotation of the manually driven actuator to the rotatable fastening head. The head rotating element may be integrally formed with the rotatable fastening head. Accordingly, the head rotating element and the rotatable fastening head may be formed from the same work piece. The head rotating element and the rotatable fastening head may as well be substance-bonded (e.g., by means of soldering). Other connections (e.g., frictional or form-fitted connections are also viable). For example, the head rotating element may be formed by a ring, tire or sprocket applied onto the rotatable fastening head.

According to further embodiments, the manually driven actuator may be arranged between the first end portion and a main holding portion of the handle designed for holding the hand tool. The manually driven actuator may delimit the end portion from the main portion of the handle. By way of example, the actuator would be designed for being operated by a human hand, in particular with one or two fingers such as the thumb and/or the index finger. By way of further example, the actuator could be directly or indirectly engaged with the rotatable fastening head respectively with the head rotating element. The actuator may thus be regarded as being part of both the main holding portion of the handle and the end portion thereof.

According to further embodiments, the actuator is rotatably supported by the handle in order to be freely rotated about a fixed axis with respect to the main axis of the hand tool. By way of example, the rotational axis of the actuator may be arranged perpendicular to the main axis of the hand tool. By way of further example, the rotational axis of the actuator would be arranged in parallel to the rotational axis of the rotatable fastening head respectively to the head rotating element. This enables a particular compact embodiment of the hand tool. Other non-parallel arrangements of the rotational axes of the actuator and of the rotatable fastening head respectively of the head rotating element are also viable.

In accordance with further embodiments, the hand tool may also comprise at least one intermediate element that is rotatably supported by the handle and which transfers a rotational movement of the actuator to the rotatable fastening head respectively to the head rotating element. According to one such embodiment, the rotational axis of the intermediate element is arranged similarly to the rotational axes of the manually driven actuator and the rotatable fastening head as described above. Hence, the rotational axes of the intermediate element, the actuator and the rotatable fastening head respectively the head rotating element are preferably arranged in parallel. As indicated above, other non-parallel arrangements of the rotational axes are also viable.

According to one such embodiment, the actuator, the head rotating element and/or the intermediate element may be of planar shape in a direction perpendicular to their rotational axis. According to a further embodiment, the actuator, the head rotating element and/or the intermediate element may be cylindrically shaped, disc-shaped or wheel-shaped. Accordingly, an overall flat and compact design of the hand tool is obtained.

According to further embodiments, the actuator, the head rotating element and/or the intermediate element may be designed for their respective engagement by means of a frictional or form-fitted connection. By way of example, these elements may be formed as gear wheels, wheels made from a plastic material such as hard rubber, wheels with a gummed running thread and the like. Also, other embodiments, for example, based on static friction (e.g., by the use of a transmission belt) are viable.

According to further embodiments, the actuator may comprise a larger diameter in a direction perpendicular to its rotational axis than the head rotating element and/or the intermediate element. According to one such embodiment, the head rotating element and the intermediate element may be formed by small discs or wheels and the actuator may be formed by a relatively larger disc or wheel. For example, the radius of the actuator may be at least two, three or four times greater than the radius of the head rotating element.

As described above, according to example embodiments, the hand tool further comprises a fixed fastening head configured for applying a preset fastening torque onto a screw to be fastened and connected to a second end portion of the handle.

According to further embodiments, the fixed fastening head extends in a direction perpendicular to the main axis of the hand tool. In this manner, the center axis of the fixed fastening means is arranged perpendicular to the main axis of the hand tool. Further, the fixed fastening head may protrude from a pivot arm connected to the main portion of the handle and which preferably constitutes the second end portion of the handle. In this context, the term "fixed" in this context relates to a fixed angular positioning of the center axis of the fastening head with respect to the main axis of the handle. The fixed fastening head is thus designed not to undergo any movement and in particular no rotational movement with respect to the handle when fastening a screw, at least as long as a preset maximum fastening torque is not exceeded.

According to further embodiments, the fixed fastening head is selectively pivotable with respect to the handle about an axis parallel to the center axis of the fixed fastening head. Thereby, the center axis of the fixed fastening head preferably corresponds to the rotational axis respectively the center axis of the screw to be fastened. Accordingly, a fixed angular orientation of the center axis of the fastening head with respect to the main axis of the handle can be maintained when selectively pivoting the fixed fastening head. In this context, the term "selectively pivotable" relates to the possibility of a user being enabled to selectively adjust the position of the pivot arm of the fixed fastening head with respect to the handle. Further, the respective position may be lockable such that any undesired movement between the fixed fastening head and the handle during a fastening operation is prevented.

In accordance with further embodiments, the hand tool comprises pivot angle adjustment means for selectively setting a pivot angle between the pivot arm of the fixed fastening head and the handle. By way of example, a pivot angle between the pivot arm to which the fixed fastening head is connected and a main portion of the handle may be set by the user of the hand tool. By way of further example, the pivot angle between the pivot arm and the handle respectively a main portion of the handle can be set to a value between −90° to +90° (e.g., the pivot angle may be set to at least the values −90°, −60°, −30°, 0°, +30°, +60°, +90°.

According to one embodiment, the pivot angle adjustment means may be designed for adapting a preset maximum fastening torque of the fixed fastening head by varying the pivot angle between the pivot arm of the fixed fastening head and the main portion of the handle. Thereby, the fastening torque may increase or decrease with an increasing absolute value of the pivot angle.

According to a further embodiment, the pivot angle adjustment means comprises a first disc-shaped female connector with circumferentially arranged connecting bores and a conformably shaped male connector comprising at least one off-center connecting pin. The pivot angle adjustment means may further comprise a tightening screw operable by a user and arranged for selectively loosening and tightening the engagement between the female and male connector of the adjustment means. Accordingly, the pivot angle of the pivot arm and the handle may be set by selectively engaging the at least one off-center connecting pin of the male connector with one of the circumferentially arranged connecting bores of the female connector.

In accordance with further embodiments, the hand tool further comprises a fastening torque limiting means for presetting and/or adjusting the maximum fastening torque applicable onto a screw by the fixed fastening head. Accordingly, the maximum fastening torque applicable onto a screw may be limited and/or adjusted by the user and thus, damages of the screw or screw connection to be fastened are prevented.

According to one such embodiment, the fastening torque limiting means may comprise a friction or slipping clutch. The fastening torque limiting means are preferably housed in the handle of the hand tool.

According to a further embodiment, the fastening torque limiting means comprise a pivotable shank connected to the pivot arm of the fixed fastening head and designed for being rotated about an axis parallel to the center axis of the fixed fastening head upon exceeding the maximum fastening torque. By way of example, the pivotable shank would be arranged for rotating about the same axis of rotation about which the pivot arm of the fixed fastening means may be selectively pivoted. The user of the hand tool may thus take notice that the maximum fastening torque is reached when the pivotable shank and thus the pivot arm of the fixed fastening head will deflect in rotational motion when fastening a screw connection.

According to further embodiments, as the slipping clutch, the pivotable shank of the fastening torque limiting means comprises a central recess at a front end portion thereof, into which a conformably shaped ball of a thrust element is biased. The thrust element presents a pressure-applying element that urges the ball into the recess of the pivotable shank with a predefined force (e.g., by means of a spring element). The predefined force is preferably adaptable by a user for example by adapting a distance between the thrust element and the central recess of the shank. Upon exceeding the preset maximum fastening torque during fastening a screw with the fixed fastening head, the ball of the thrust element will leave the central recess and move along a shoulder portion of the recess. As the ball is not seated within the central recess any longer, the pivotable shank will be able to deflect.

According to one such embodiment, the rotational movement of the pivotable shank of the fastening torque limiting means is preferably limited to a predefined angle of rotation. For this purpose, the pivotable shank may comprise a stopping means, such as a bore interacting with a conformably shaped pin of the handle, wherein the bore may be of a larger diameter than the pin interaction therewith. The stopping means are thus designed for restricting a rotational movement respectively a rotational deflection of the pivotable shank. Accordingly, upon exceeding the preset maximum fastening torque, which is indicated by the deflection of the pivotable shank, the user may apply a further rotational movement onto the screw in the same rotational direction, thereby applying an unlimited fastening torque if desired.

The fastening torque limiting means may be designed for limiting the fastening torque in one rotational direction of the fixed fastening head only. Accordingly, a predefined limited torque may be applied when fastening a screw connection while an unlimited torque may be applied when loosening a screw connection. By way of example, a preset maximum fastening torque may be set to a value between 0.4 to 0.9 Nm, or a value between 0.5 to 0.7 Nm, or specifically to 0.58 Nm. Thereby, the preset fastening torque is set during a manufacturing process of the hand tool. This may be obtained by adjusting the applied force of the thrust element onto the pivotable shank and detecting the maximum fastening torque of the hand tool with a dedicated torque detection device. By way of further example, the maximum fastening torque may as well be adjustable by a user of the hand tool (e.g., by turning a thrust element within a dedicated support member of the handle). Thereby, the biasing force of the thrust element onto the pivotable shank may be adjusted which results in an adaptation of the maximum fastening torque of the hand tool. For this purpose, the handle may comprise a dedicated access opening which allows the user to access at least a rear portion of the thrust element.

According to further embodiments, the hand tool comprises a sandwich structure. According to one such embodiment, the handle of the hand tool comprises a front and rear panel that form the outer portions of the handle. Between these front and rear panels, the rotatable fastening head and the manually-driven actuator are mounted. The torque limiting means are also arranged between the front and rear panels. Thereby, the pivotable shank of the torque limiting means is connected via a joint to the front and rear panels. The pivot arm to which the fixed fastening head is connected is also connected to the front and rear panels by a dedicated joint. Further, the axis of rotation of the pivot arm of the fixed fastening head and the axis of rotation of the pivotable shank of the torque limiting means correspond.

According to further embodiments, the hand tool may further comprise tool receiving means that are designed for selectively receiving and securing different tools or fastening heads of varying profile. Accordingly, a user may selectively connect different tools or so-called "bits" to the tool receiving means, which thus present the respective fastening heads. Thereby, the tool receiving means for the fixed fastening head are designed for fixedly engaging the respective fastening head.

Accordingly, embodiments of the present invention provide for improved hand tool configurations for tightening and loosening screw connections under restricted spatial conditions.

The freely rotatable fastening head of the tool may be used for conveniently tightening screw connections by merely rotating the actuator of the rotatable fastening head, which translates the movement onto the fastening head situated at the first end portion of the hand tool. Thereby, the size of the actuator is preferably adapted to the size of a finger of a user, while the size of the rotatable fastening head and the first end portion of the hand tool may be adapted to the screw connection to be fastened and to the spatial conditions at the location of the screw connection.

The fixed fastening head for applying a preset fastening torque, which may be selectively pivotable with respect to the handle, enables an adaptation of the angular orientation of the pivot arm of the fixed fastening head to the particular spatial conditions of the screw connection to be fastened. Further, the pivot arm to which the fixed fastening head is connected may be adapted in its size to the respective spatial conditions. By way of example, the pivot arm is of reduced diameter and/or lateral extension compared to the main portion of the handle of the hand tool.

Further, embodiments of the present invention enable a convenient fastening operation of screw connections under restricted spatial conditions with a single hand tool only. Thereby, the rotatable fastening head may be used in a first tightening step, and the torque sensitive fixed fastening head may be used in a second tightening step in which an optimal fastening torque is applied onto the screw connection.

Additionally, embodiments of the present invention further enable the construction of waveguide connections by focusing more on the electric requirements of the waveguides and less on the assembly limitations due to the restricted spatial conditions in the waveguide.

BRIEF DESCRIPTION OF THE DRAWINGS

Example embodiments of the present invention are illustrated by way of example, and not by way of limitation, in the figures of the accompanying drawings, in which like reference numerals refer to similar elements, and in which.

DETAILED DESCRIPTION

Figure 1A:
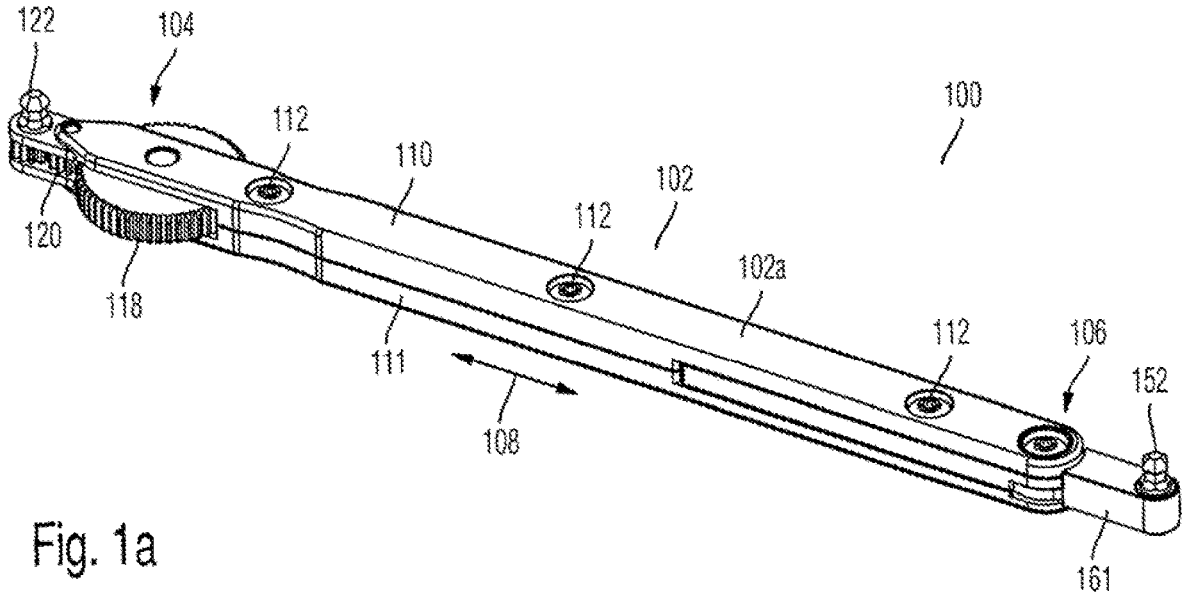
FIG. 1*a* shows a first perspective side view of a hand tool, according to example embodiments of the invention.

FIGS. 1-5 illustrate a hand tool 100 according to example embodiments of the present invention. The hand tool comprises a handle 102 with a first and second end portion 104, 106. The center of the handle 102 between the first and second end portions 104,106 forms a main or gripping portion 102*a* of the handle. The length of the hand tool along its main axis 108 may be between 10 and 25 cm, preferably between 10 and 15 cm. The first and second end portions 104, 106 may comprise a length between 1-4 cm, preferably between 1 and 3 cm.

Figure 1B:
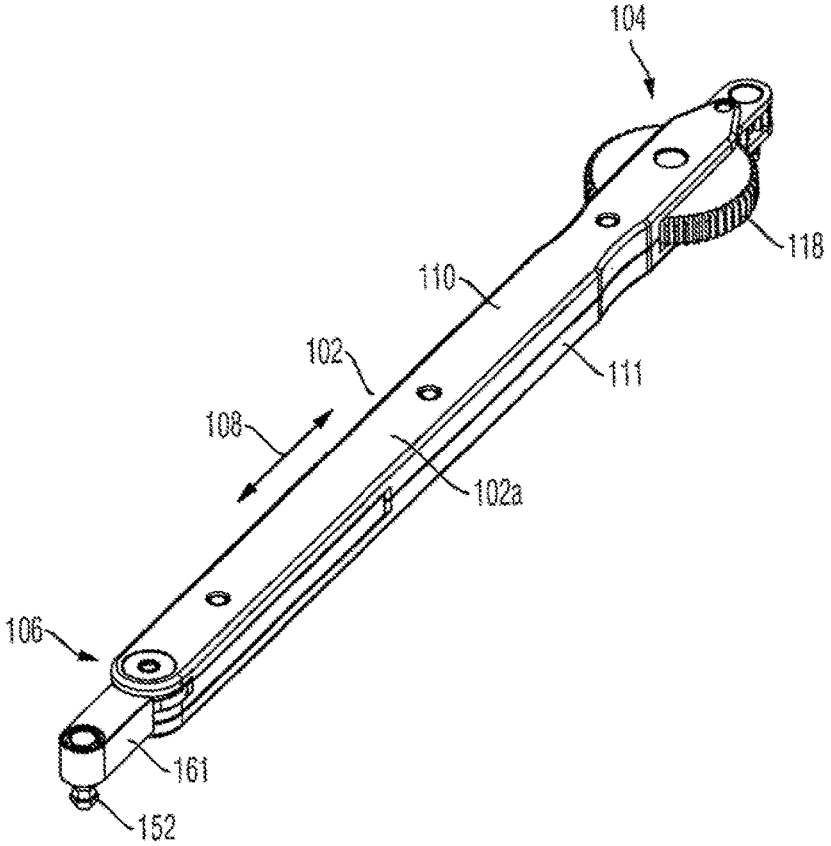
FIG. 1*b* shows a second perspective side view of a hand tool, according to example embodiments of the invention.

According to the embodiments of FIGS. 1*a* and 1*b*, the hand tool is essentially rod-shaped, whereby the first and second end portions 104, 106 oppose each other. Other embodiments are however viable, in which the hand tool comprises more than the illustrated first and second end portions and in which the hand tool may be of essential L- or X-shaped form.

The main or gripping portion 102*a* of the handle 102 is designed for being gripped by the user when operating the hand tool. By way of example, the gripping portion 102*a* may be round or of planar shaped as shown in the figures. The handle 102 is formed of two panels 110, 111 which are preferably made from metal and which may be of essentially conformal shape. The two panels 110, 111 may be connected by suitable connection means such as screws 112, rivets or the like. In a further embodiment, the panels 110, 111 are selectively detachable in order to access the enclosed further parts of the hand tool such as in particular a torque limiting means 150.

The hand tool 100 comprises a rotatable fastening head 122 at a first end portion 104 of the handle 102 and a fixed fastening head 152 at a second end portion 106 of the handle 102. The rotatable and fixed fastening heads 122, 152 are designed for tightening or loosening a screw connection, in particular by engaging a profile section of screw head.

The rotatable fastening head 122 and the fixed fastening head 152 comprises a hexagonal cross-sectioned profile with a ball end 142 for connecting to a correspondingly shaped hexagonal screw head profile. Other profiles of the fastening heads are however also possible. Furthermore, the rotatable fastening head 122 and the fixed fastening head 152 may have different fastening profiles.

According to the embodiments of the figures, the fastening heads 122, 152 protrude from the handle 102 in the same direction. Thereby, the respective center axes 128, 158 of the fastening heads 122, 152 are orientated parallel to each other. It will be understood, that also non-parallel arrangements of the center axes 128, 158 or arrangements in which the fastening heads 122, 152 protrude to different sides of the handle 102 are possible.

Figure 2A:
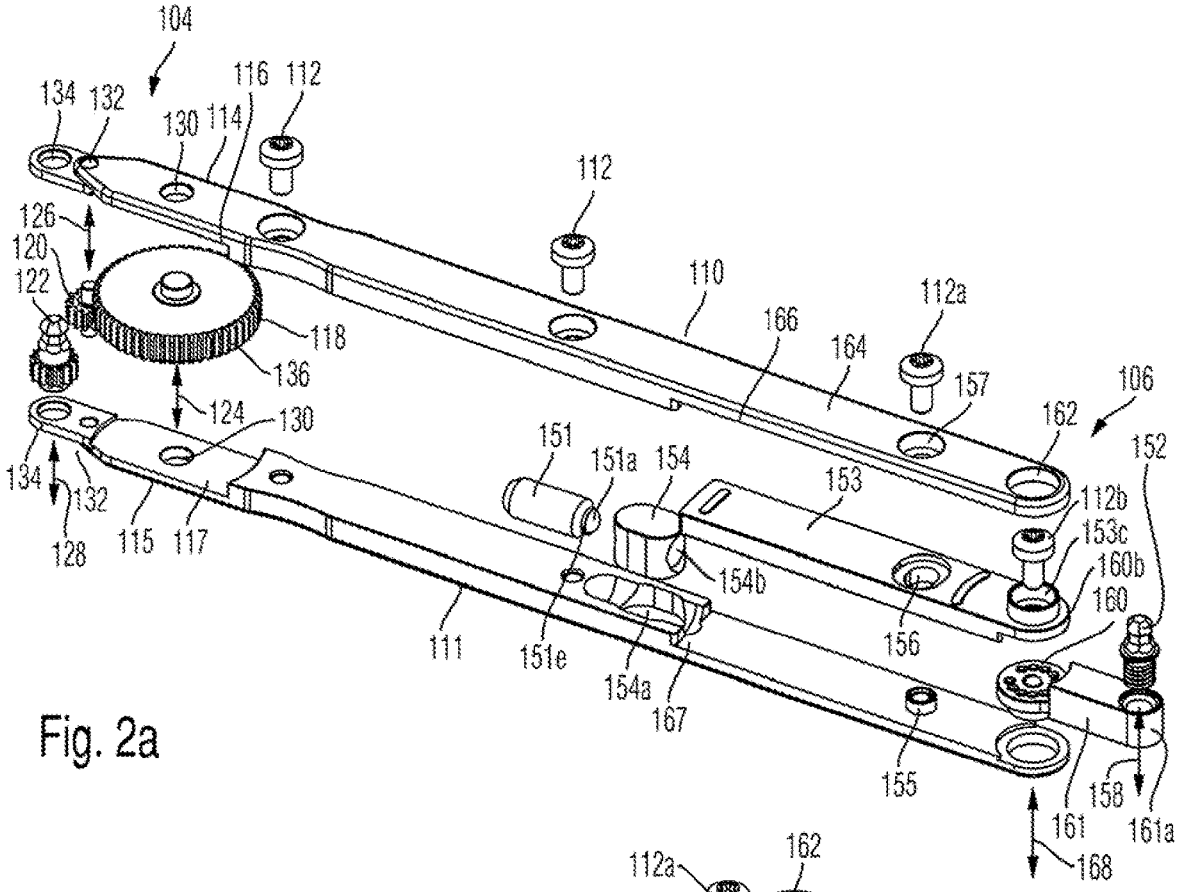
FIG. 2*a* shows an expanded view of the hand tool of FIG. 1*a;*
Figure 2B:
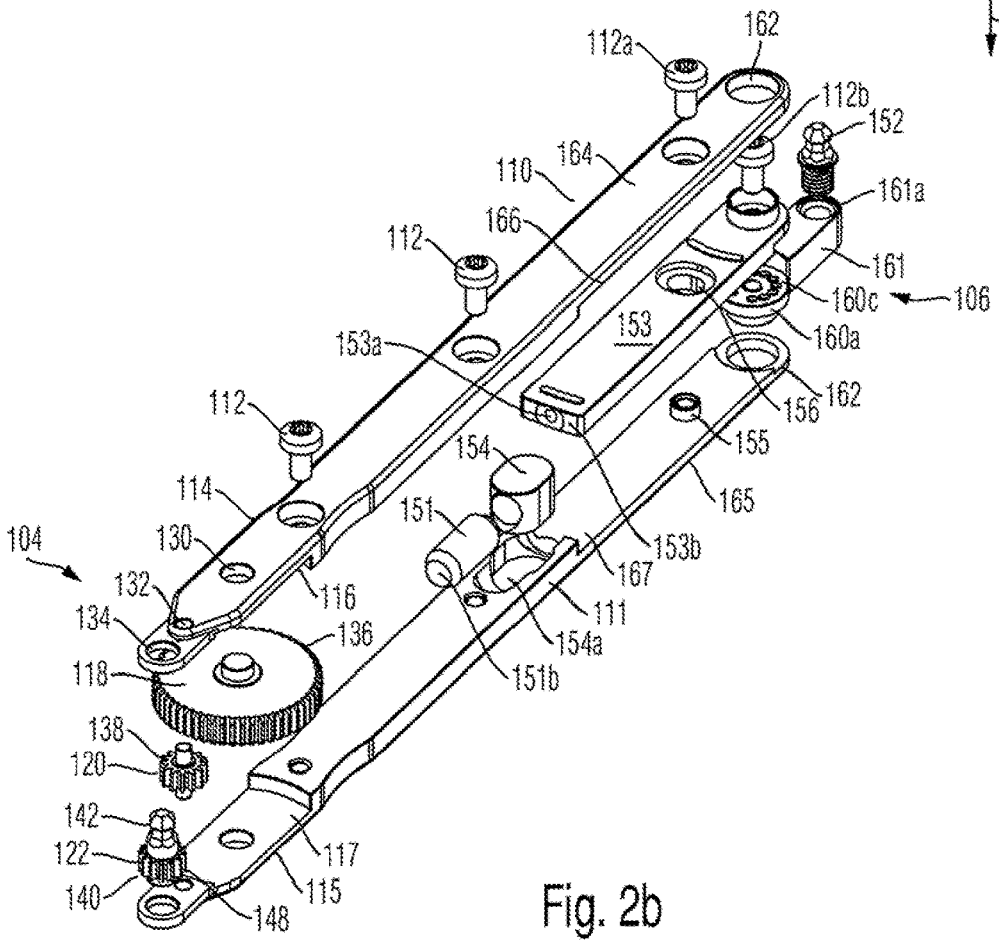
FIG. 2*b* shows an expanded view of the hand tool of FIG. 1*b;*

According to the embodiments of FIGS. 2*a* and 2*b*, at the first end portion 104 of the handle 102, the panels 110, 111 comprise beams 114, 115 which are distanced from each other due to recesses 116, 117 of the panels 110, 111. Further, in the recesses 116, 117 an actuator 118, an intermediate element 120 and the rotatable fastening head 122 are rotatably mounted. By way of example, the actuator 118, the intermediate element 120 and the rotatable fastening head 122 may be formed by planar disc-shaped elements with rotational axes 124, 126, 128. These axes are mounted in correspondingly arranged support bores 130, 132, 134 of the panels 114, 115.

By way of further example, the actuator 118 is formed by a wheel with corrugations 136. The intermediate element 120 is formed as gear wheel with gear ring 138. The rotatable fastening head 122 is integrally formed with a head rotating element 140, wherein the head rotating element 140 comprises a gear ring 148. The rotating elements 118, 120, 122 are formed as solid parts. In an alternative embodiment, the actuator 118 may as well comprise recesses or apertures and may be formed as spoked wheel such as to enable an improved view of the user towards the assembly location.

The actuator 118 is arranged between the gripping area 102*a* of the handle 102 and the first end portion 104 thereof such that the user may grip the hand tool 100 at the gripping area 102*a* and may at the same time rotate the actuator 118 with the thumb or the index finger of the gripping hand.

A rotation of the actuator 118 in a given rotational direction translates via the intermediate element 120 to a rotation of the rotatable fastening head 122 in the same rotational direction. By way of example, the actuator 118 comprises a larger diameter as the intermediate element 120 and the rotatable fastening head 122. The resulting transmission leads to the rotatable fastening head 122 being rotated multiple times for a single rotation of the actuator 118.

The intermediate element 120 and the head rotating element 140 may be chosen as being of essentially similar size as shown in the figures. Accordingly, the relatively large actuator 118 is further distanced from the location of the screw to be fastened in restricted spatial conditions.

With the rotatable fastening head 122 a screw may be tightened in a familiar way upon using one or two fingers, but with an increased velocity dependent on the chosen transmission. The tightening of a screw connection is thus faster than with the bare fingers or when using known screw drivers or offset screw drivers.

The rotational axes 124, 126, 128 may be parallel to each other, which contributes to a planar and compact design of the hand tool 100. Further, each of the axes 124, 126, 128 may be arranged perpendicular to the main axis 108 of the hand tool 100.

The first end 104 of the handle 102 is designed to provide very compact dimensions for facilitating the accessibility to screw connections. Thereby, the rotatable fastening head 122 is arranged on the outermost end of the first end portion 104 (e.g., the hand tool 100 is essentially void of parts that are protruding beyond the fastening head 122). By way of example, the rotatable fastening head 122 itself is not substantially larger than the head of a screw respectively of a fastening profile of a screw head to be fastened. The rotating head element 140 (e.g., more specifically, the geared portion 148 thereof for engaging with the intermediate element 120) presents the support element of the rotatable fastening head 122 between the panels 114, 115 (e.g., which prevents the disengagement of the rotatable fastening head 122 from panels 114, 115). By way of further example, the length of the rotatable fastening head 122 along the rotational axis 128 is of a length as necessary for provision of the geared portion 148 and the support of the rotatable fastening head 122 between the panels 110, 111. Accordingly, the first end portion 104 is of planar shape perpendicular to the rotational axis 128 and may have a thickness comparable or even smaller than one or two human fingers used for direct tightening of a screw connection.

At the second end portion 106, the panels 110, 111 comprise beams 164, 165, which are distanced from each other due to recesses 166, 167 of the panels 110, 111. In the recesses, 166, 167, a pivotable shank 153 is located, which is at least partially rotatably movable about an axis 168 of a joint 160 located at the second end portion 106. By way of example, the pivotable shank 153 is of essentially flat design and preferably conformably formed with the outer panels 110, 111. In its central position as shown in FIGS. 2*a* and 2*b*, the pivotable shank 153 extends along the main axis 108 of the handle 102. When rotating about joint 160, the pivotable shank rotates about axis 168 and deflects to the side (see also FIGS. 4*a* and 4*b*).

The fixed fastening head 152 of the hand tool 100 is protruding from the handle 102 along a central axis 158 in a direction perpendicular to the main axis 108 of the hand tool 100.

The fixed fastening head 152 is connected to a pivot arm 161, which is connected to the handle 102. According to one embodiment, the pivot arm 161 is of elongated form and extends along an axis 169 (see FIG. 5) from the joint 160 of the handle 102. By way of example, the pivot arm 161 may be essentially rod-shaped or cylindrically shaped. Further, the pivot arm 161 may comprise a cross-sectional form which corresponds to the cross-sectional form of the handle 102. By way of example, the pivot arm 161 comprises smaller lateral dimensions (e.g., in a direction perpendicular to its extension axis 169) than the handle 102. Accordingly, the pivot arm 161 may facilitate the access of a screw connection by the fixed fastening head 152 in restricted spatial conditions. By way of example, the pivot arm 161 comprises a length of between 1 and 4 cm, more preferably between 1.5 to 2.5 cm.

The fixed fastening head 152 may be integrally formed with the pivot arm 161 or may be formed as separate piece. The pivot arm 161 may comprise tool receiving means 161*a* at a distal portion thereof to which the fixed fastening head 152 may be selectively connected. The tool receiving means 161*a* may be a threaded bore into which dedicated tools or so-called "bits" of various profile may be connected by the user.

Figure 3A:
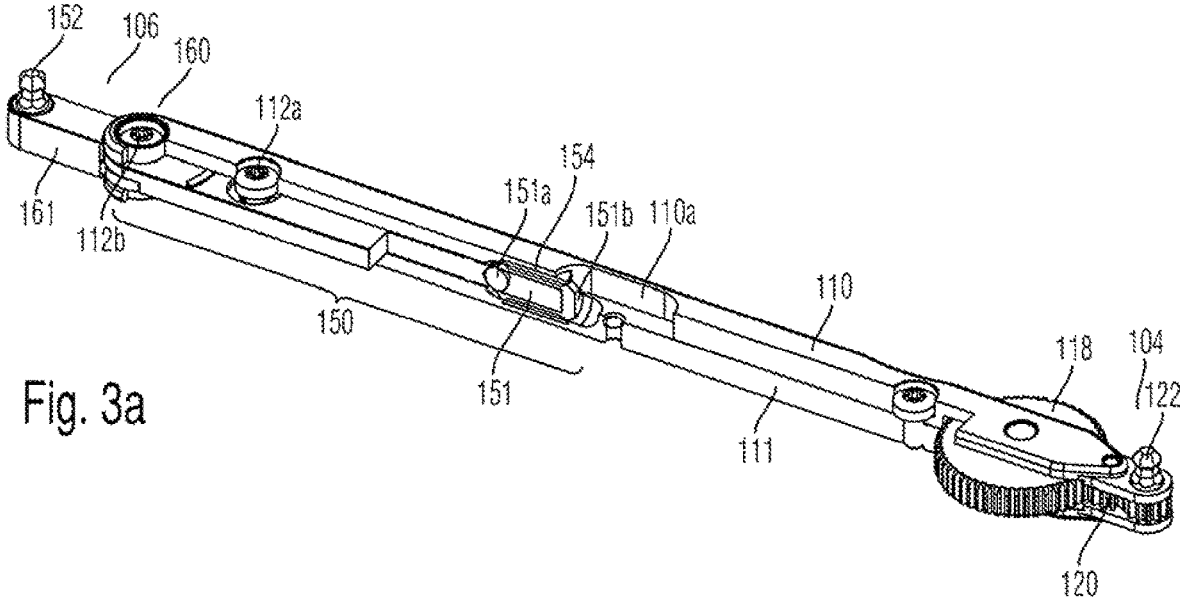
FIG. 3*a* shows a perspective sectional side view of the hand tools of FIGS. 1*a* and 1*b;*
Figure 3B:
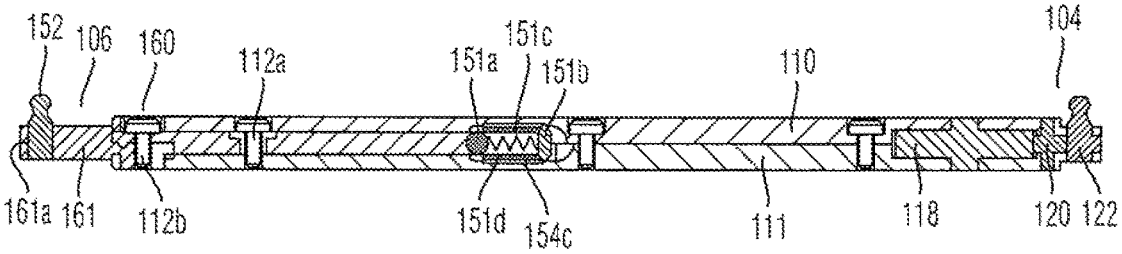
FIG. 3*b* shows a sectional side view of the hand tool according to FIGS. 1*a* and 1*b;*
Figure 4A:
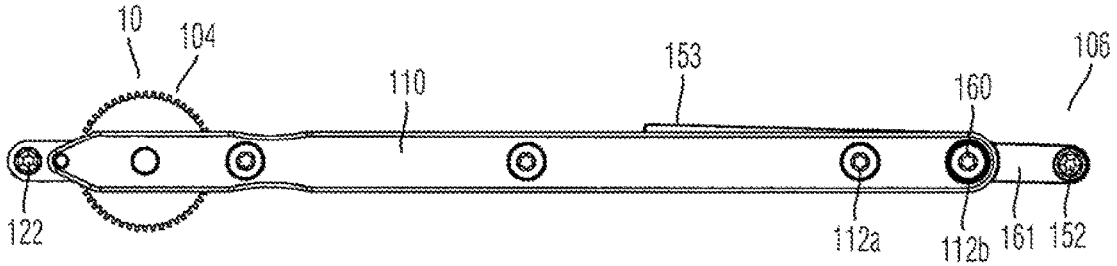
FIG. 4*a* shows a top view of the hand tool of FIGS. 1*a* and 1*b;*
Figure 4B:
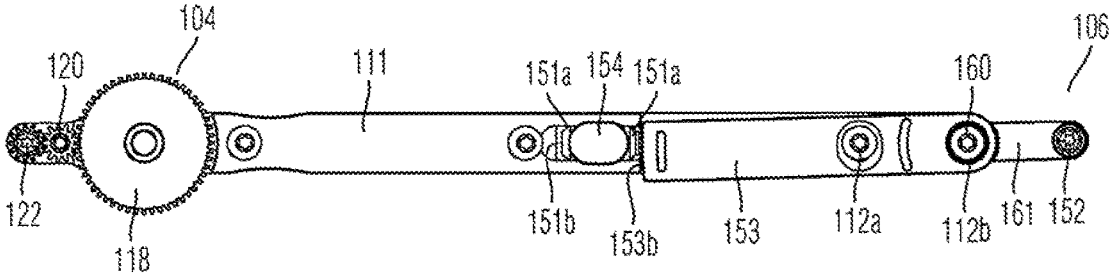
FIG. 4*b* shows a sectional top view of the hand tool of FIGS. 1*a* and 1*b*.

As shown in FIGS. 3*a* and 3*b*, the pivot arm 161 is designed for being selectively rotatable about the axis 168 of joint 160. Accordingly, the pivot arm 161 and the fixed fastening head 152 are designed for being rotated about the axis 168 arranged in parallel to the central axis 158 of the fixed fastening head 152.

The hand tool 100 further comprises pivot angle adjustment means 160*a*, 160*b*, 160*c*, 112*b* designed for selectively setting a pivot angle $\alpha$ between the main axis 108 of the hand tool 100 and the extension axis 169 of the pivot arm 161. Thereby, the angle $\alpha$ is situated in a plane which lies perpendicular to the central axis 158 of the fixed fastening head 152 and the axis 168 of joint 160 (see also FIG. 5). The pivot angle adjustment means are preferably an integral part of the joint 160 of the hand tool 100.

According to one embodiment, the pivot angle adjustment means 160*a*, 160*b*, 160*c*, 112*b* comprise a first disc-shaped female connector 160*a* with circumferentially arranged connecting bores 160*c* and a conformably shaped male connector 160*b* comprising at least one off-center connecting pin (not shown) which fits into the connecting bores 160*c*. The pivot angle adjustment means further comprise a tightening screw 112*b* operable by a user and arranged for selectively loosening and tightening the engagement between female and male connector 160*a*, 160*b* of the adjustment means. The screw 112*b* may extend from panel 110 to a central bore of the female connector 160*a*. Accordingly, the pivot angle $\alpha$ of the pivot arm 161 and the handle 102 respectively the main axis of the hand tool 100 may be set by selectively engaging the at least one off-center connecting pin of the male connector 160*b* with one of the circumferentially arranged connecting bores 160*c* of the female connector 160*a* in a loose state of the tightening screw 112*b*.

The hand tool 100 further comprises fastening torque limiting means 150 (see FIG. 3*a*), which are supported in the handle 102. The fastening torque limiting means 150 are designed for presetting and/or adjusting the maximum fastening torque applicable onto a screw by the fixed fastening head 152.

According to one embodiment, the torque limiting means 150 comprise a thrust element 151 and a thrust element support 154, which are received in a further recess 154*a* of the main or gripping portion 102*a* of the handle. The torque limiting means 150 further comprises the pivotable shank 153, which is engaged with the thrust element 151 via a front end portion 153*b* comprising a central recess 153*a*. The front end portion 153*b* of the pivotable shank 153 is arranged opposite to an end portion at which the shank 153 is connected to the joint 160 via a dedicated bore 153*c*. A ball

151*a* located at a front of the thrust element 151 is biased into the central recess 153*a* of the pivotable shank 153 by means of an internal spring element 151*c*. The thrust element 151 is held within a central bore 154*b* of the thrust element support 154 via an outer threaded portion 151*d* of the thrust element 151 which engages with an internal thread 154*c* of the bore 154*b*. By turning the thrust element 151 within the bore 154*b* of the thrust element support 154, the axial position of the thrust element 151 along main axis 108 with respect to the recess 153*a* in the front end portion of the pivotable shank 153 may be varied. Accordingly, the biasing force of the thrust element 151 onto the recess 153*a* and thus onto the pivotable shank 153 may be adjusted, which results in an increased or decreased maximum torque for the fixed fastening head 152.

The ball 151*a* of the thrust element 151 is held within a housing of the trust element 151 by a protruding support lip 151*e* (e.g., a circumferentially protruding support lip), which protrudes radially inwards from an outer lateral wall in order to hold the ball 151*a* within the thrust element 151.

For turning the thrust element 151 within the threaded bore 154*b*, the rear portion 151*b* of the thrust element 151 comprises a profiled section such as a slot or cross-recess. In order to enable a user to access the rear portion 151*b* of the thrust element 151 when separating the panels 110, 111 of the handle 102 and thus to adapt the biasing force respectively the maximum fastening torque of the fixed fastening head 152, the panel 110 may comprise an optional access opening 110*a* as shown in FIG. 3*a*.

The thrust element 151 thus applies a biasing force via the ball 151*a* onto the central portion of the recess 153*a*, which biasing force will be overcome when exceeding a predefined maximum fastening torque via the rotation of the handle 102 about the central axis 158 of the fixed fastening head 152 onto the pivotable shank 153. In this case, the ball 151*a* will leave the central recess 153*a* and contact a shoulder portion of the recess or the front end portion 153*b* of the pivotable shank, outside of the central recess 153*a* (see FIG. 2*b*). Thereby, the pivotable shank 153 together with the pivot arm 161 and the fixed fastening head 152 will be deflected about the joint 160 (see e.g. FIGS. 4*a* and 4*b*). This indicates to the user of the hand tool 100 that a preset maximum fastening torque for the fixed fastening head 152 is exceeded.

A rotational movement of the pivotable shank 153 may be limited to a predefined deflection angle. For this purpose the hand tool 100 may comprise stopping means 155, 156 which are designed to restrict the angular deflection of the pivotable shank 153. The stopping means may comprise a bore 156 in the pivotable shank 153 into which a pin 155 protruding from the recess 167 in the panel 111 is engaged. The pin 155 may comprise an outer diameter smaller than the inner diameter of the bore 156. A screw 112*a* may engage with a central bore provided within pin 155 which may be tightened or loosened in order to adjust a play of the pivotable shank 153 with respect to the handle panels 110, 111. Upon exceeding a preset maximum fastening torque, the shank 153 will deflect about joint axis 168 to such degree at which the outer lateral wall of the pin 155 engages with an inner lateral surface of the bore 156. Upon the sudden contact of these surfaces when the preset maximum torque is reached, a "click" sound will be noticed by the user of the hand tool 100 which informs the user about the maximum fastening torque being reached respectively exceeded.

The shoulder or front end portion 153*b* of the pivotable shank 153 is may be slanted towards the central recess 153*a* such that the ball 151*a* will be urged towards the central recess 153*a* when the applied fastening torque is reduced. This leads to a self-centering effect of the pivotable shank 153 with regards to the handle 102.

Figure 5:
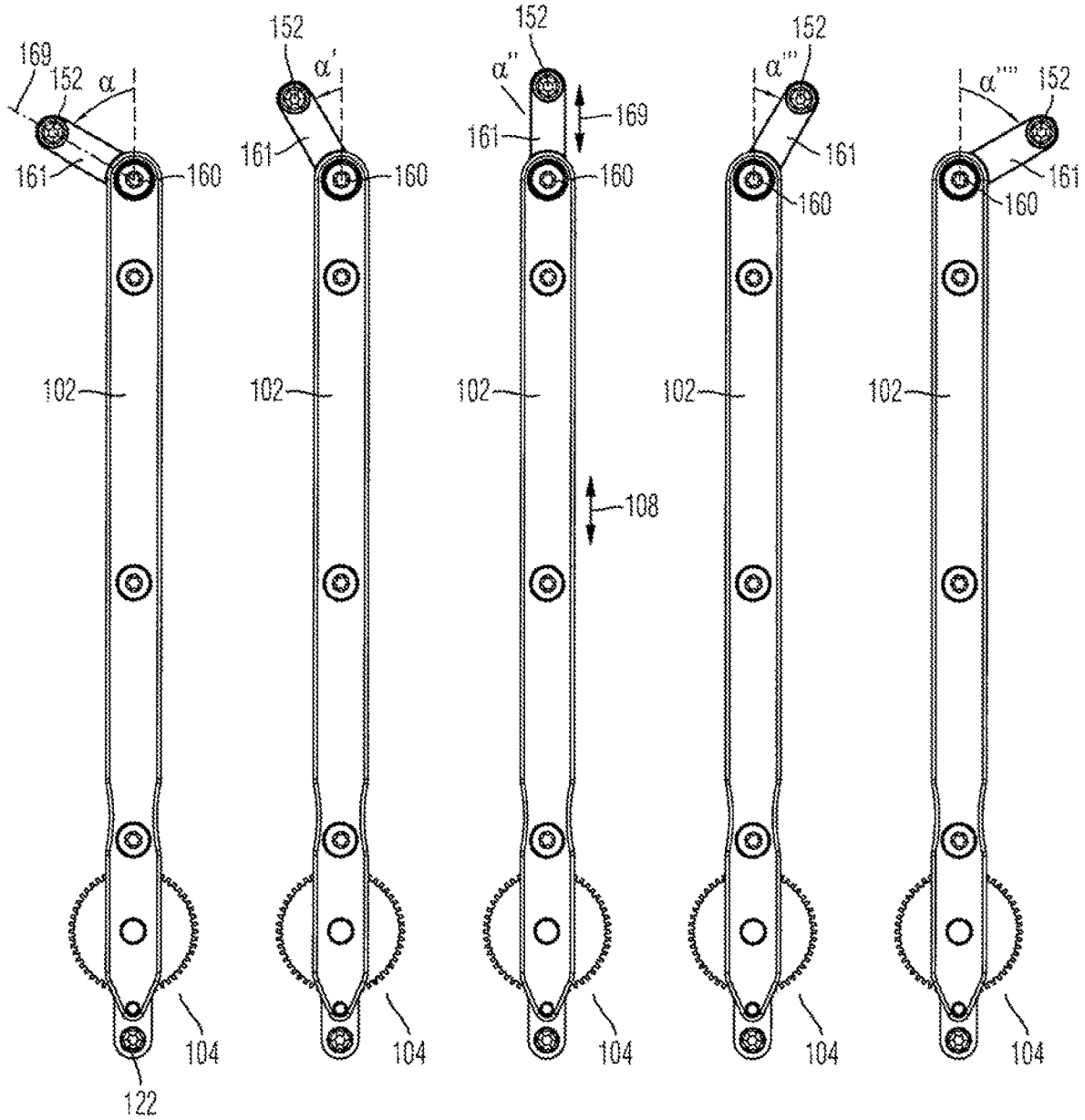
FIG. 5 shows several top views of a hand tool, with the pivot arm of the fixed fastening head assuming various positions with respect to a handle of the hand tool, according to example embodiments of the invention.

FIG. 5 illustrates different positions of the pivot arm 161 to which the fixed fastening head 152 is connected with respect to the handle 102. Thereby, a pivot angle $\alpha$ between the extension axis 169 of the pivot arm 161 and the main axis 108 of the hand tool 100 may be selectively adapted. It is noted that the pivot arm 161 is locked in the respective position with respect to the handle 102 such that the fixed fastening head 152 will not undergo a movement with respect to the handle 102 during a fastening operation, at least as long as the preset maximum fastening torque is not reached.

From left to the right, the angle $\alpha$ between the extension axis 169 of the pivot arm 161 and the main axis 108 of the hand tool 100 respectively of the handle 102 may be set to a value of $\alpha=-60°$, $\alpha'=-30°$, $\alpha''=0°$, $\alpha'''=+30°$, $\alpha''''=+60°$, when seen in top view (e.g., in a direction parallel to the center axis 158 of the fixed fastening head 152). The angle $\alpha$ is set by the different engagement positions of the male connector 160*b* with the female connector 160*a* of the pivot angle adjustment means (see FIGS. 2*a* and 2*b*).

The second end 106 of the handle 102 respectively the pivot arm 161 to which the fixed fastening head 152 is connected is designed to provide very compact dimensions for facilitating the accessibility to screw connections. The fixed fastening head 152 is arranged on the outermost end of the second end portion 106 respectively at the outermost distal portion of the pivot arm 161. Accordingly, the hand tool 100 is void of parts that are protruding beyond the fixed fastening head 152. Further, the fixed fastening head 152 itself is not substantially larger than the head of a screw respectively of a fastening profile of a screw head to be fastened. The second end portion 106 is of essentially planar shape perpendicular to the center axis 158 and may have a thickness comparable or even smaller than one or two human fingers used for direct tightening of a screw connection.

All features of all embodiments described in the description, shown in the drawings and/or claimed in the claims herein can be combined with each other.

While various embodiments of the present invention have been described above, it should be understood that they have been presented by way of example only, and should not be regarded in a limited sense. Various changes to the disclosed embodiments can be made in accordance with the disclosure herein without departing from the spirit or scope of the invention. Thus, the breadth and the scope of the present invention should not be limited by any of the above-described embodiments. Rather, the scope of the invention should be defined in accordance with the following claims and their equivalence.

Although, the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one implementation, such feature may be combined with one or more other features of the other implementations as may be desired and advantageous for any given or particular application.

What is claimed is:

1. A tool comprising:

a handle;

a rotatable fastening head connected to a first end of the handle and engaged with a manually driven actuator;

a fixed fastening head connected to a second end of the handle via a pivot arm, wherein the pivot arm is configured to be selectively pivotable with respect to the handle about an axis parallel to a center axis of the fixed fastening head via a pivot connection between the pivot arm and the handle; and a torque limiter comprising a thrust element held within a thrust element support with a front end of the thrust element engaged with a first end of a pivotable shank via a biasing element positioned at the front of the thrust element and biased against the first end of the pivotable shank, and wherein a second end of the pivotable shank is pivotally connected to the pivot connection; and wherein a recess of the handle is configured to receive the thrust element and the thrust element support, wherein the thrust element is configured to be rotated within the thrust element support, and wherein rotation of the thrust element within the thrust element support adjusts a force of an engagement of the biasing element with the first end of the pivotable shank which adjusts a configurable torque to be applied to the fixed fastening head via the pivot connection of the second end of the pivotable shank to the pivot connection and a connection of the pivot arm to the pivot connection.

2. The tool according to claim 1, wherein the center axis of the fixed fastening head corresponds to a rotational axis of the fastener.

3. The tool according to claim 1, further comprising:

a pivot angle adjustment component configured to selectively set a pivot angle between the pivot arm and the handle.

4. The tool according to claim 3, wherein the pivot angle can be selectively set to a value between −90° and +90°.

5. The tool according to claim 3, wherein the pivot angle can be selectively set to any one of a plurality of angle values including −90°, −60°, −30°, 0°, +30°, +60°, +90°.

6. The tool according to claim 3, wherein the pivot angle adjustment component is configured to set the configurable torque to be applied to the fixed fastening head by varying the pivot angle.

7. The tool according to claim 6, wherein the configurable torque increases with an increasing absolute value of the pivot angle.

8. The tool according to claim 3, wherein the pivot angle adjustment component comprises a first disc-shaped female connector with circumferentially arranged connecting bores and a conformably shaped male connector comprising at least one off-center connecting pin.

9. The tool according to claim 8, wherein the pivot angle adjustment component further comprises a tightening element configured to selectively loosen and tighten the engagement between the first disc-shaped female connector and the conformably shaped male connector of the pivot angle adjustment component.

10. The tool according to claim 1, wherein the torque limiter is configured to set a maximum for the configurable torque to be applied by the fixed fastening head.

11. The tool according to claim 10, wherein the pivotable shank is configured to pivot about the axis parallel to the center axis of the fixed fastening head upon exceeding the maximum for the configurable torque.

12. The tool according to claim 11, wherein the pivoting of the pivotable shank is limited to a predefined angle of rotation.

13. The tool according to claim 10, wherein the torque limiter is configured to limit the configurable torque applied by the fixed fastening head in only one rotational direction of the fixed fastening head.

14. The tool according to claim 10, wherein the torque limiter is positioned in the handle.

15. The tool according to claim 10, wherein the torque limiter comprises a slipping clutch.

16. The tool according to claim 10, wherein the maximum for the configurable torque is set to a value between 0.4 and 0.9 Newton meters.

17. The tool according to claim 10, wherein the maximum for the configurable torque is set to a value between 0.5 and 0.7 Newton meters.

18. The tool according to claim 10, wherein the maximum for the configurable torque is set to 0.58 Newton meters.

19. The tool according to claim 1, further comprising:

a tool receiving component configured to selectively receive and secure different fastening heads of varying profiles for different respective fasteners.

20. The tool according to claim 1, wherein the tool is configured in a structure with two opposing sides sandwiched together to secure components of the tool.

* * * * *